US008068026B1

(12) United States Patent
Delerno et al.

(10) Patent No.: US 8,068,026 B1
(45) Date of Patent: Nov. 29, 2011

(54) PERIODIC TESTER TO DETERMINE READINESS OF A FIRE PUMP SYSTEM

(76) Inventors: Manuel J. Delerno, Geneva, IL (US); Vincent O. Rodriguez, Montgomery, IL (US)

( * ) Notice: Subject to any disclaimer, the term of this patent is extended or adjusted under 35 U.S.C. 154(b) by 115 days.

(21) Appl. No.: 12/655,370

(22) Filed: Dec. 29, 2009

(51) Int. Cl.
*G08B 21/00* (2006.01)

(52) U.S. Cl. ..... 340/540; 340/7.63; 340/286.05; 340/287; 340/292; 169/13; 169/67; 169/16; 169/51; 169/52

(58) Field of Classification Search ..... 340/540, 340/7.63, 286.05, 287, 292; 169/13, 67, 169/16, 51, 52, 65; 239/349, 124, 146, 148
See application file for complete search history.

(56) References Cited

U.S. PATENT DOCUMENTS

| | | | | | |
|---|---|---|---|---|---|
| 4,222,711 | A | | 9/1980 | Mayer | |
| 4,290,735 | A | | 9/1981 | Sulko | |
| 4,428,434 | A | | 1/1984 | Gelaude | |
| 4,611,290 | A | * | 9/1986 | Henningsen et al. | 700/283 |
| 5,221,189 | A | | 6/1993 | Henningsen | |
| 5,549,456 | A | | 8/1996 | Burrill et al. | |
| 5,680,329 | A | * | 10/1997 | Lloyd et al. | 700/275 |
| 5,950,150 | A | | 9/1999 | Lloyd et al. | |
| 6,676,382 | B2 | | 1/2004 | Leighton et al. | |
| 7,309,216 | B1 | | 12/2007 | Spadola, Jr. et al. | |
| 7,513,315 | B2 | * | 4/2009 | Boyle et al. | 169/16 |
| 7,845,424 | B1 | * | 12/2010 | Miller | 169/13 |
| 2001/0026225 | A1 | * | 10/2001 | Young | 340/606 |
| 2005/0183868 | A1 | | 8/2005 | Taylor et al. | |
| 2005/0257938 | A1 | * | 11/2005 | Elsey | 169/16 |
| 2006/0151184 | A1 | * | 7/2006 | Boyle | 169/14 |
| 2006/0162438 | A1 | | 7/2006 | Schofield et al. | |
| 2007/0192062 | A1 | * | 8/2007 | Gentile et al. | 702/182 |
| 2007/0286737 | A1 | | 12/2007 | Johnson | |

* cited by examiner

*Primary Examiner* — Hoi Lau
(74) *Attorney, Agent, or Firm* — Matthew R. P. Perrone; Brie A. Crawford

(57) ABSTRACT

A periodic tester to determine the readiness of a fire pump system interfaces with a fire pump controller, an electric motor, and a sprinkler system. The fire pump controller has a power on/off sensor which interfaces with an electric motor which starts the fire pump to provide water to the sprinkler system. The power on/off system has a contactor coil as a component. The periodic tester targets two of the main components of fire system failure: the power on/off sensor and the contactor coil. The periodic tester may be retrofitted to existing systems and interface either directly or indirectly with the power on/off sensor to accommodate both systems that have a solenoid valve and those that do not. The periodic tester is designed to attempt to start the system only once during a set cycle. Any failure to start is displayed through audible and visual alarms.

15 Claims, 9 Drawing Sheets

PERIODIC TESTER TO DETERMINE READINESS OF A FIRE PUMP SYSTEM

This invention relates to a periodic tester to determine readiness of fire pump system and more particularly to a periodic tester to determine readiness of fire pump system which facilitates monitoring of a fire pump system without the need for human intervention.

BACKGROUND OF THE INVENTION

The need for immediate usability of a fire pump system at the time of a fire is obvious. Periodic testing to insure this is essential but unfortunately not always applied. Moreover, the present monitoring systems require human intervention. This is a two-part problem in that first, the human has to be skilled in monitoring the system for it to be effective, and secondly, the human has to be consistent in periodically monitoring the system. A system which is less dependent on human intervention will be a desirable invention.

Also, the failure of the fire pump controller to start the fire pump motor when needed is most likely due to the failure of two key components. The components that are most likely to cause the failure are the contactor coil and the power on/off pressure switch. A system which monitors these two key components will be a useful invention.

Finally, replacing existing systems to incorporate system which monitors these key components without human intervention is expensive. A system which has these capabilities, yet can be retrofitted to existing systems will be a useful invention.

SUMMARY OF THE INVENTION

Among the many objectives of the present invention is the provision of a periodic tester to determine readiness of a fire pump system which can detect contactor coil failure.

Another objective of the present invention is the provision of a periodic tester to determine readiness of a fire pump system which can be conveniently housed in an enclosure mounted adjacent to the fire pump controller.

Also, an objective of the present invention is the provision of a periodic tester to detect readiness of a fire pump system which has an audible indication of the failure of the electric motor to start automatically until the alarm is stopped manually.

Moreover, an objective of the present invention is the provision of a periodic tester to determine readiness of a fire pump system which either does not disable a normally functioning fire pump system or causes continuous fire pump operation if the periodic tester malfunctions, when interwired per National Electrical Code.

A still further objective of the present invention is the provision of a periodic tester to determine readiness of a fire pump system whose period cycle time is adjustable to one week or less.

Yet another objective of the present invention is the provision of a periodic tester to determine readiness of a fire pump system which does not require human intervention to operate.

Also, another objective of the present invention is the provision of a periodic tester to determine readiness of a fire pump system which can be retrofitted to existing fire pump systems.

These and other objectives of the invention (which other objectives become clear by consideration of the specification, claims and drawings as a whole) are met by providing a retrofitted periodic tester for a fire pump which monitors both the contactor coil and the power on/off pressure switch, without the need for human intervention, and sounds an alarm when failure occurs.

BRIEF DESCRIPTION OF DRAWINGS

Throughout the figures of the drawings, where the same part appears in more than one figure of the drawings, the same number is applied thereto.

DESCRIPTION OF THE PREFERRED EMBODIMENTS

Until recently, there was no requirement for automatic periodic starting of an electric motor driven fire pump, and reliance on the performing of periodic testing were governed by human interest, supported by requirements not rigidly enforced, or even monitored. Since that time, however, all new fire pump controllers are equipped to meet the automatic periodic starting requirement of simulated output system pressure decrease to the normal starting pressure, followed by an immediate alarm indication if the fire pump controller fails to start the motor.

This invention identifies each of the two components of the fire pump controller most likely to have failed prior to an automatic periodic start attempt. This identification by non-technical personnel makes correction of the failure much more timely, hence, reducing the out of service time of the fire pump system.

This invention makes the periodic testing less dependent on human capability. Further, it identifies the two leading causes of failure of the fire pump controller to start the fire pump motor when needed, the contactor coil and the power on/off pressure switch.

The distinguishing feature of this invention is the improved data presentation of the fire pump controller component or components failure which enables faster correction of the failed condition. Furthermore, this data presentation makes it possible for operating personnel having limited electrical knowledge to provide considerable information to a follow-up technical repair technician.

This invention is intended to periodically monitor the readiness of the fire pump controller to start the motor when needed. It is not intended to monitor other deficiencies which may exist in the fire pump system such as closed system discharge valve, open-circuited motor, broken motor-pump coupling and other potential problems. It does not monitor fire pump controller control and alarm components not associated with the starting equipment.

Figure 1:
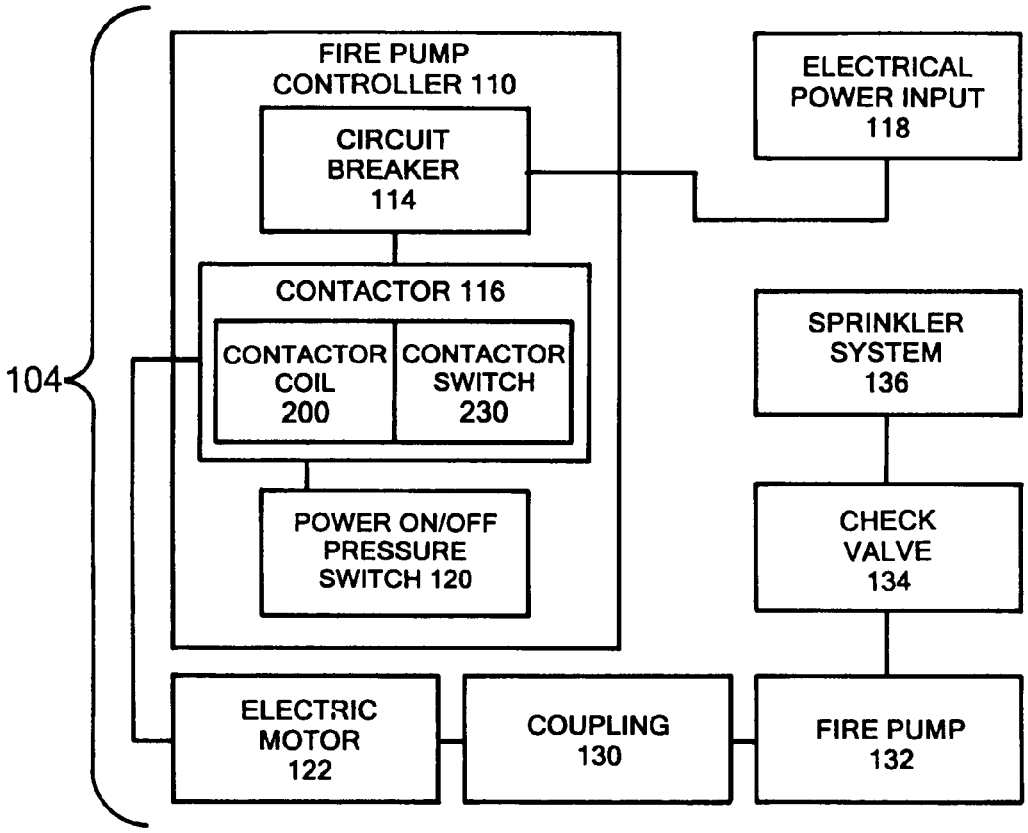
FIG. 1 depicts a block diagram of the prior art.

Now referring to FIG. 1, the typical electric fire pump system 104 of the prior art can be seen. Electrical power input 118 is delivered to the circuit breaker 114 and then delivered to contactor (sometimes referred to as "contactor assembly") 116. The contactor 116 is a contactor switch 230 having an electrically operating closing contactor coil 200, which when activated by power on/off pressure switch 120 will allow electrical power to flow to the electric motor 122 when there is a pressure decrease in sprinkler system 136. Between electric motor 122 and fire pump 132 is a coupling 130 which connects the two in a working relationship. The mechanical output power of the electric motor 122 is delivered to the fire pump 132 where it is converted to hydraulic power in the fire pump 132 and becomes usable power when there is water flow in the sprinkler or standpipe piping system 136.

Either the sprinkler or standpipe piping system 136 is normally a static hydraulic system, but becomes dynamic when activated directly or indirectly by heat or smoke, usually during a fire scenario. Automatic starting because of a fire is accomplished by sensing the pressure on the sprinkler system 136 at the pump discharge check valve 134. The resulting rate of water flow is dependent upon the number of sprinkler heads or standpipe hoses 136 opened; thereby determining the hydraulic power delivered to extinguish the fire.

Figure 2A:
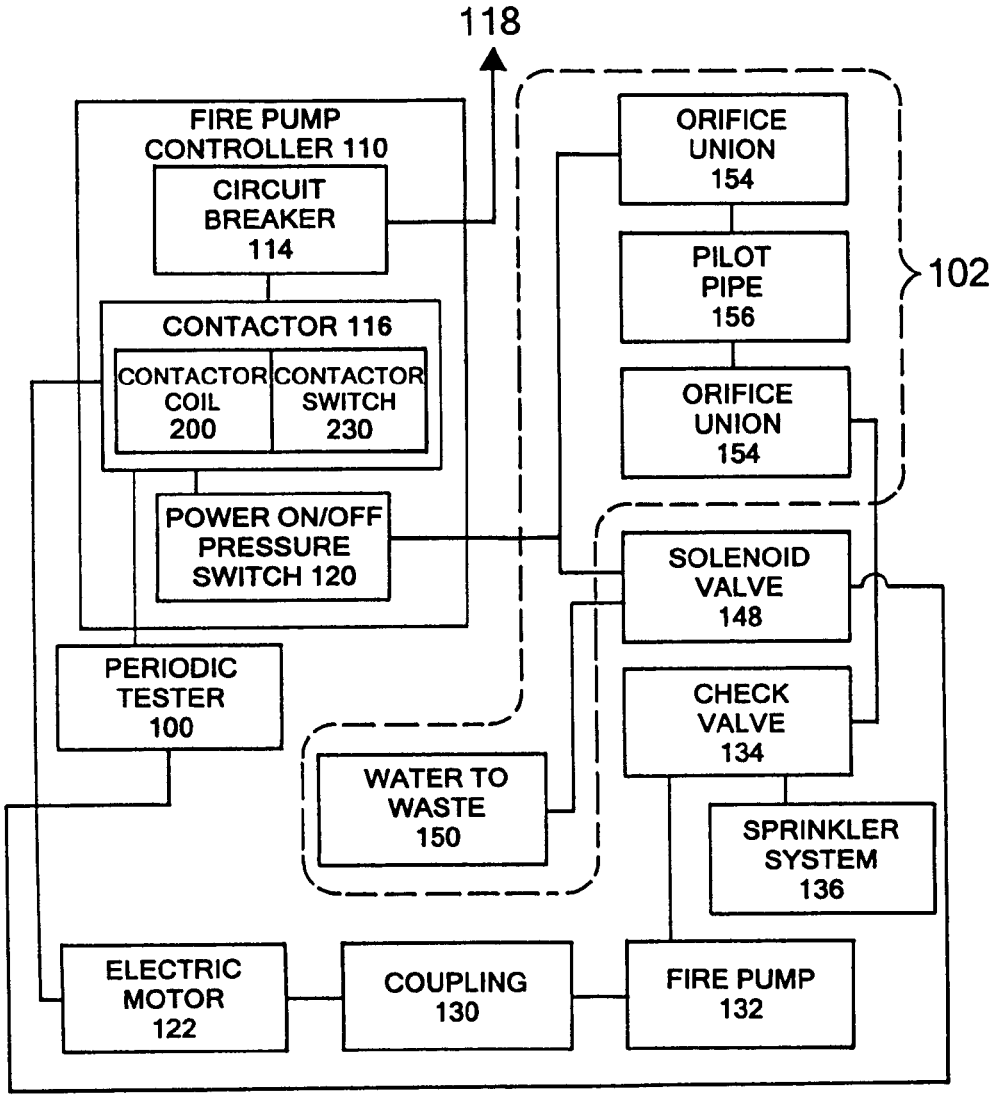
FIG. 2*a* depicts a block diagram of the prior art monitored by the periodic tester 100 of this invention.

Now referring to FIG. 2*a*, the monitoring of the typical electrical fire pump system 104 by the periodic tester 100 can be seen. Electrical power input 118 is delivered to the circuit breaker 114 and then delivered to contactor 116. The contactor 116 is a contactor switch 230 having an electrically operating closing contactor coil 200, which when activated by power on/off pressure switch 120 will allow electrical power to flow to the electric motor 122 when there is a pressure decrease in sprinkler system 136.

Automatic starting because of a fire is accomplished by sensing the pressure on the sprinkler system 136 at the pump discharge check valve 134. The pressure is transmitted by the pilot piping 156 to a power on/off pressure switch 120. The pilot piping 156 contains two orifice unions 154 which minimize pressure surges to the power on/off pressure switch 120.

Fire pump 132 is preferably a centrifugal pump with output characteristics of decreasing pressure with increasing flow. Fire pump 132 is connected to the public water supply or any suitable supply of water in great enough amounts to properly extinguish a fire.

Periodic tester 100 can monitor different versions of the existing systems including those with a solenoid valve 148 and those without. Some versions of pilot piping 156 have a solenoid valve 148 to discharge water to waste 150 at the end of the pilot piping 156. A periodic time clock 140 activates solenoid valve 148 whereupon there is a fairly rapid drop in pressure at the power on/off pressure switch 120 due to the limited water flow through the orifice unions 154. When the pressure at the power on/off pressure switch 120 falls to the start setting of the power on/off pressure switch 120 as a result of either a fire or an automatic periodic command to start, the electric motor 122 starts. Electric motor 122 starts when the power on/off pressure switch 120 activates the contactor 116 via the contactor coil 200 to supply electric power to the electric motor 122 to start. Between electric motor 122 and fire pump 132 is a coupling 130 which connects the two in a working relationship.

Now adding FIG. 3, FIG. 4, FIG. 5, FIG. 6*a*, and FIG. 6*b* to the consideration, periodic time clock 140 is programmed for repetitive ON/OFF operation with the ON time being much shorter than the OFF time. One complete cycle is usually one week, but can be set for a lesser time if premise protection from fire damage is paramount.

There is only one attempt to start on each ON-OFF cycle, whether successful or not. Upon periodic time clock 140 closing its contacts, it energizes time delay relay 170 as well as the third control relay 178 (sometimes referred to as "CR3"). The contact of the periodic time clock does not directly close the contactor 116 to start the fire pump 132 but applies power to solenoid valve 148 causing it to open and start water flow in the water to waste 150 which decreases pressure to the power on/off pressure switch 120 in the fire pump controller 110. Fire pump controller 110 is contained in a housing.

If the power on/off pressure switch 120 is functioning properly, then prior to the completion of the timing period set on time delay relay 170, the power on/off pressure switch contacts 120 will close and cause voltage to be applied to the contactor coil 200 which, if not open or short circuited will energize the contactor 116 to deliver power 118 to start electric motor 122. Lastly, under this normal operating mode, at a slightly later time when time delay relay 170 time period expires, third control relay 178 will dropout, the solenoid valve 148 will close again, and pressure in the pressure sensing line 102 up to the solenoid valve 148 will rise to the pump discharge pressure. The fire pump controller 110 will remain energized until both the running period timer in the controller 110 and the pressure on the power on/off pressure switch 120 exceeds its stop setting. Time delay relay 170 does not reset itself until periodic time clock 140 transfers to the OFF period, thereby providing the single start attempt during each ON-OFF cycle.

Third control relay 178 has a normally open contact which closes immediately with the transfer of periodic time clock 140 from OFF to ON. This closure energizes alarm time delay relay 172 (sometimes referred to as "TDR 1") through the instantaneously closed time delay relay 170 contacts which remains closed and continue to time out until first control relay 174 (sometimes referred to as "CR1") energizes. First control relay 174 is connected across two of the three output power terminals of the contactor 116. The setting of the time delay period of the time delay relay 170 must be greater than the normal interval of time between closure of the power on/off pressure switch contacts and the closure of the contactor 116 in fire pump controller 110 to prevent the conclusion of the single start attempt before the contactor 116 normally closes.

Now, the malfunction of fire pump controller 110 is added to the consideration and illustrated. As mentioned earlier, the time opening contact of time delay relay 170 must be greater than the time closing contact of alarm time delay relay 172. The third control relay 178 drops out as time delay relay 170 times out which causes alarm time delay relay 172 to dropout if it is still energized.

If in the normally operating sequence, if no water discharges to waste 150 when solenoid valve 148 is opened, a malfunction is present. The malfunction is likely the result of a plugged or otherwise distorted pressure sensing line 102.

If, however water discharges to waste and the pump does not start, then the power on/off pressure switch 120 is most likely unresponsive, improperly set, or otherwise defective, causing the malfunction. Or, the malfunction may be a failed contactor coil 200. The malfunction may be a combination of more than one of the above, or not related to any of the above. At this point, a further analysis of the system is necessary.

In the event of this malfunction, alarm time delay relay 172 will time out because first control relay 174 did not pick up which energized first alarm relay 160 (sometimes referred to as "AR1") which results in the illumination of failure to start light 180 and the sounding of audible alarm 186. Audible alarm 186 is silenced and failure to start light 180 is extinguished by pressing alarm reset switch 184. At this point, the periodic tester 100 will remain in the quiescent state until the next operation of the periodic time clock 140.

Adding to the consideration, another scenario is when the periodic tester activates a malfunctioning system. In this scenario, the sequence follows the normal sequence and solenoid valve 148 opens and water flows to waste 150. However, fire pump controller 110 does not start fire pump 132. Alarm time delay relay 172 times out, causing the first alarm relay 160 to pick up and the failure to start light 180 is illuminated, and audible alarm 186 sounds, But, in addition, second control relay 176 (sometimes referred to as "CR2") which is connected across contactor coil 200, is energized which indicates there is voltage present across an open circuited contactor coil 200. If a short circuited contactor coil 200 occurs, it will burn to an open circuited coil rapidly as there is no overload current protection in the contactor coil circuit 200.

When second control relay 176 is energized, its normally open contact closes which illuminates the coil failure alarm light 182. In actuality, both failure to start light 180 and coil failure alarm light 182 will illuminate almost simultaneously.

When the second control relay 176 is energized but the first control relay 174 has not picked up because of contactor coil 200 failure, the contact of the second control relay 176 will cause the second alarm relay 162 (sometimes referred to as "AR2") to pick up and the coil failure alarm light 182 is illuminated.

Figure 4:
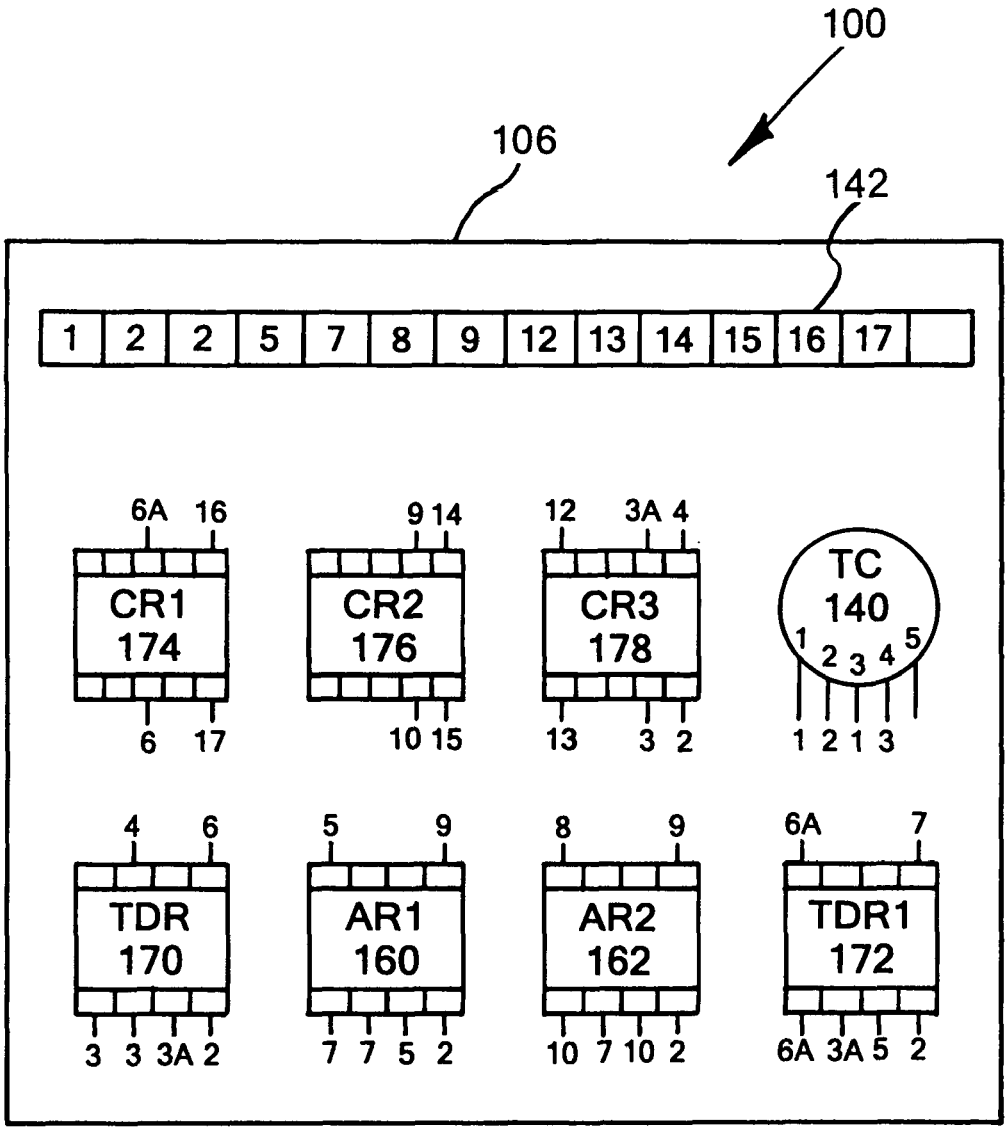
FIG. 4 depicts a mechanical diagram of the content of cabinet 106 of this invention.

Now adding FIG. 4 to the consideration, the contents of cabinet 106, housing periodic tester 100, can be clearly seen. First control relay 174, second control relay 176, and third control relay 178 are present and interconnected to terminal block 142. First alarm relay 160 and second alarm relay 162 are present and connected to terminal block 142 and second control relay 176 and third control relay 178. Time delay relay 170 and alarm time delay relay 172 are present and connected to terminal block 142 and first control relay 174, third control relay 178, first alarm relay 160, and second alarm relay 162. Also, the periodic time clock 140 is present and connected to the terminal block 142, third control relay 178, time delay relay 170, first alarm relay 160, second alarm relay 162, alarm time delay relay 172.

Figure 2B:
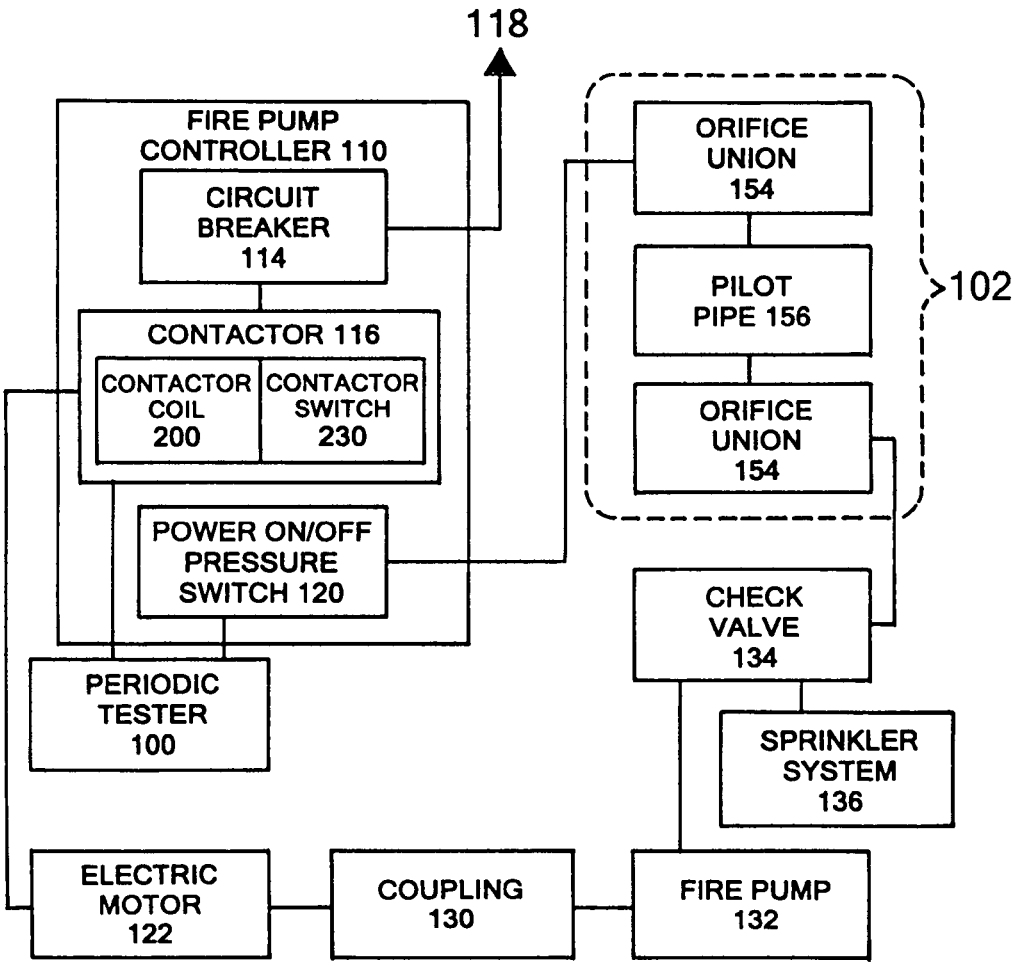
FIG. 2*b* depicts a block diagram of the prior art, without solenoid valve 148, monitored by the periodic tester 100 of this invention.
Figure 3:
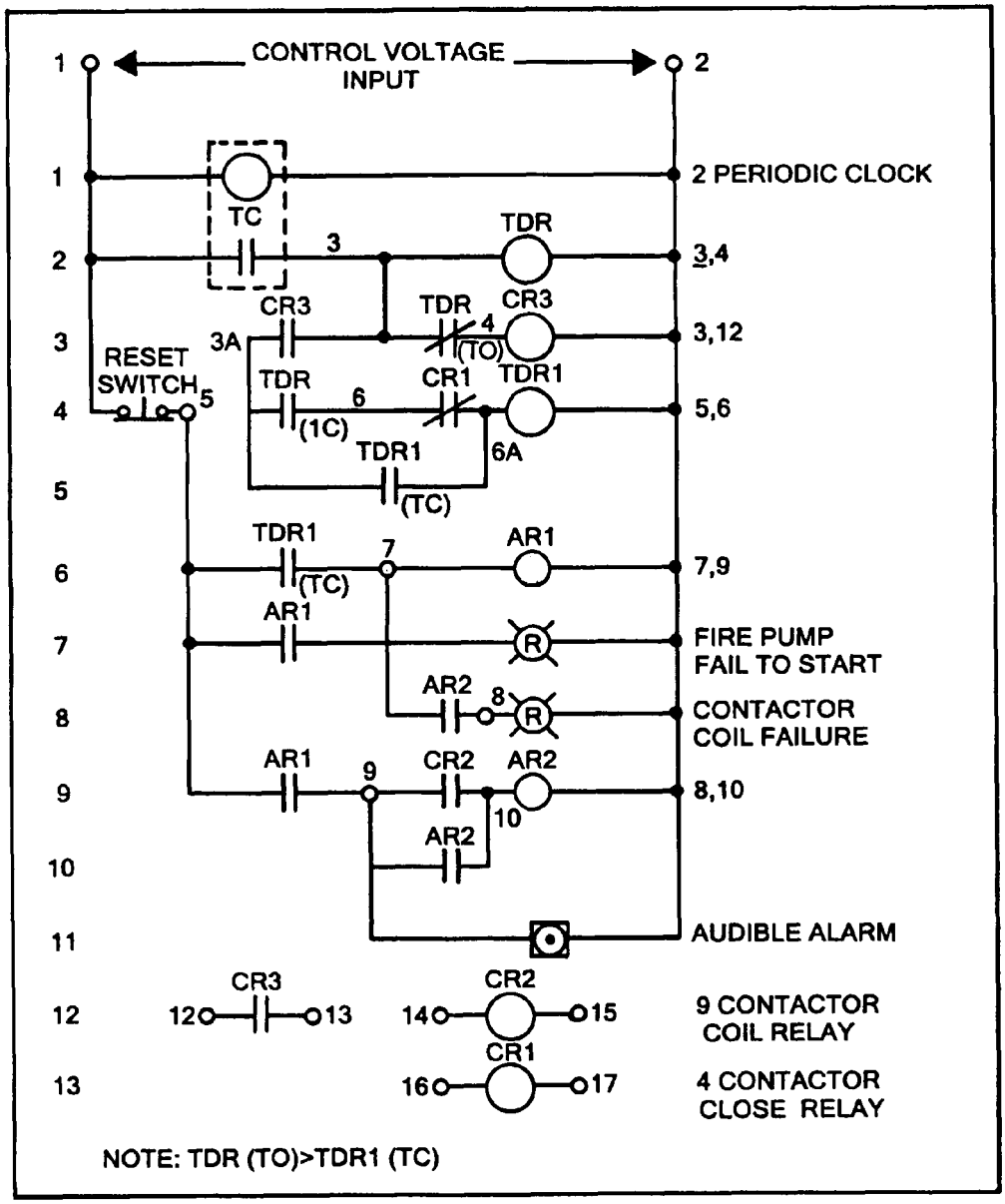
FIG. 3 depicts a schematic view of the periodic tester 100 of this invention.
Figure 6A:
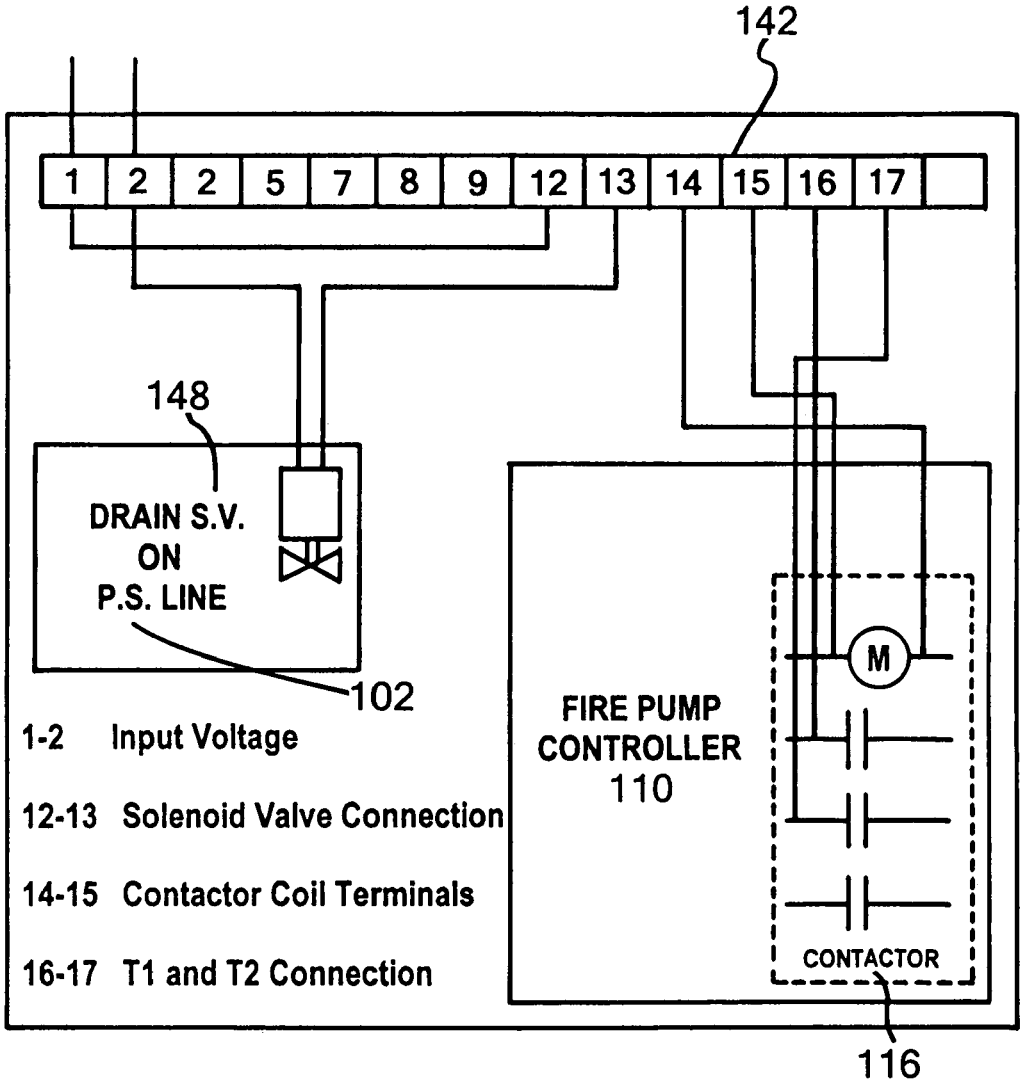
FIG. 6*a* depicts an electrical wiring diagram of the terminal connections of the periodic tester 100 of this invention.
Figure 6B:
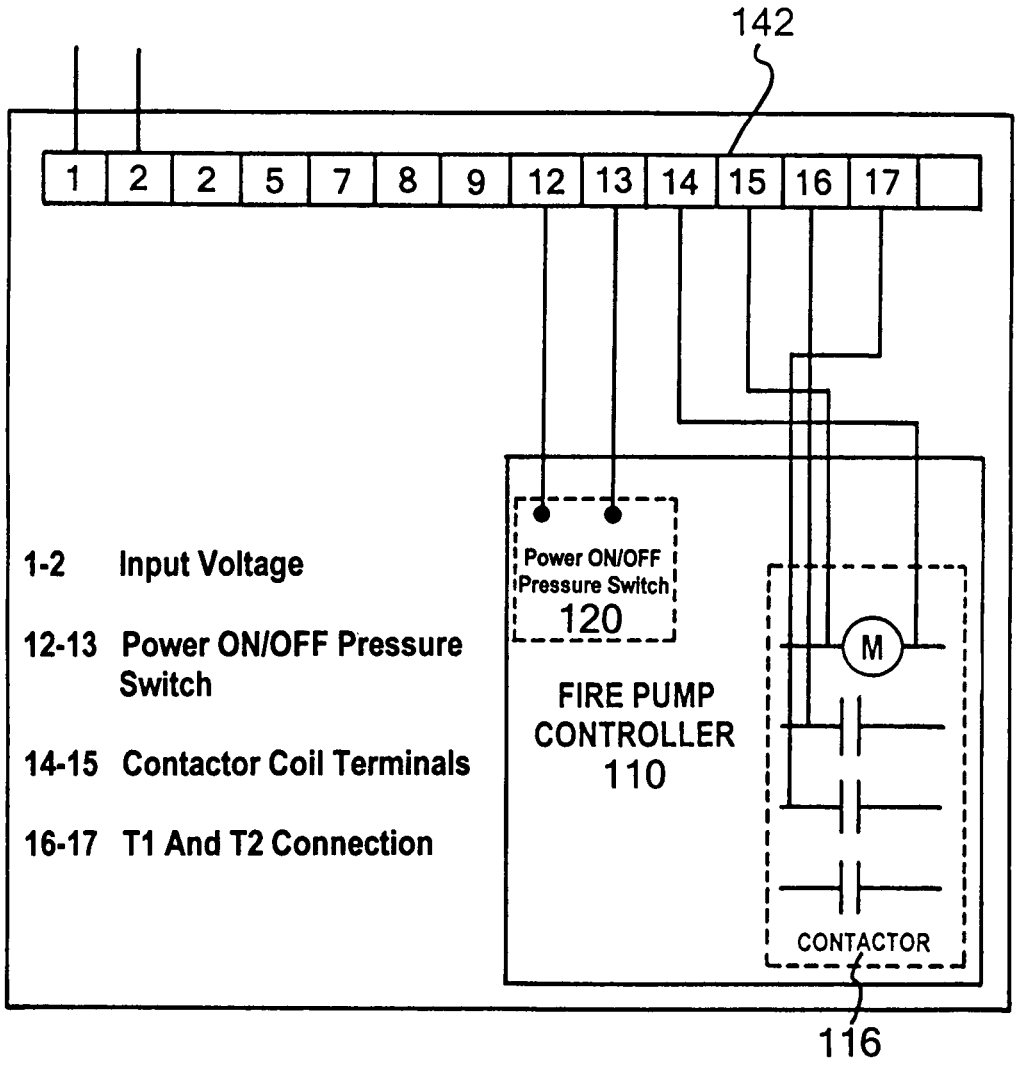
FIG. 6*b* depicts an electrical wiring diagram, without solenoid valve 148, of the terminal connections of the periodic tester 100 of this invention.

Now adding FIG. 2*b* and FIG. 6*b* to the consideration, in an alternate embodiment, periodic tester 100 can be retrofitted to an existing system which lacks a solenoid valve 148. In this embodiment the periodic tester 100 connects directly to the power on/off pressure switch 120. Periodic tester 100 functions the same as described with a few minor variations, mainly in the initial phases. Periodic tester 100 directly activates the power on/off pressure switch 120 and simulates a water pressure drop. The periodic tester 100 connects to power on/off pressure switch 120 through connections with terminal block 142 and more specifically with direct connections to terminals 12 and 13. The periodic tester 100 jumper starts the power on/off pressure switch 120. A relay switch may be used to jumper start the power on/off pressure switch 120 or any other suitable mechanism to provide the desired connection. In this embodiment, the output from the third control relay 178 is used to jumper start the power on/off pressure switch 120.

Figure 5:
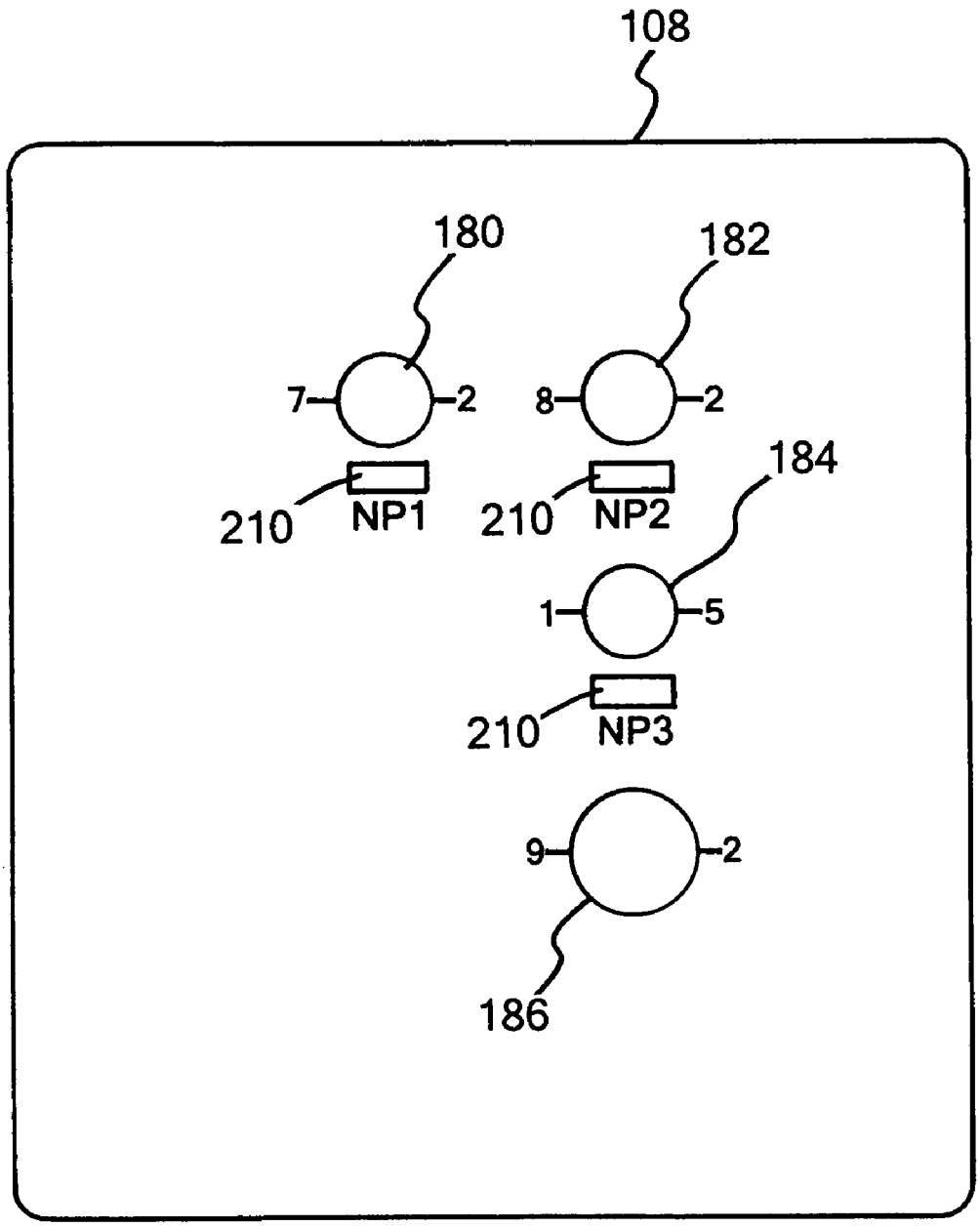
FIG. 5 depicts a mechanical diagram of the content of door 108 of this invention.

Referring specifically to FIG. 5 to the consideration, the contents of door 108, of cabinet 106 which houses periodic tester 100, can be clearly be seen. Door 108 has a series of name plates 210 which indicate which light or signal is represented at each place. Door 108 has failure to start light 180. If the fire pump 132 fails to start during a testing cycle, then failure to start light 180 is activated to indicate the failure. This allows personnel to contact appropriate service technicians to remedy the problem.

Also, door 108 has coil failure alarm light 182. If contactor coil 200 is responsible for the failure of fire pump 132 during testing operations, this light is activated. This allows personnel to contact appropriate service technicians to remedy the problem.

Finally, door 108 has reset button 184. If the fire pump 132 fails to start during a routine testing operation, audible alarm 186 will sound. Personnel can press reset button 184 to shut off audible alarm 186. An optional embodiment is counter 202 which counts the number of times reset button 184 has been successively reset before appropriate service technicians repair the problem. Counter 202 can be reset once the problem has been addressed by an appropriate repair technician. Counter 202 can be electrical, mechanical, or any other suitable mechanism. Counter 202 can be on the exterior or interior of cabinet 106.

Figure 7:
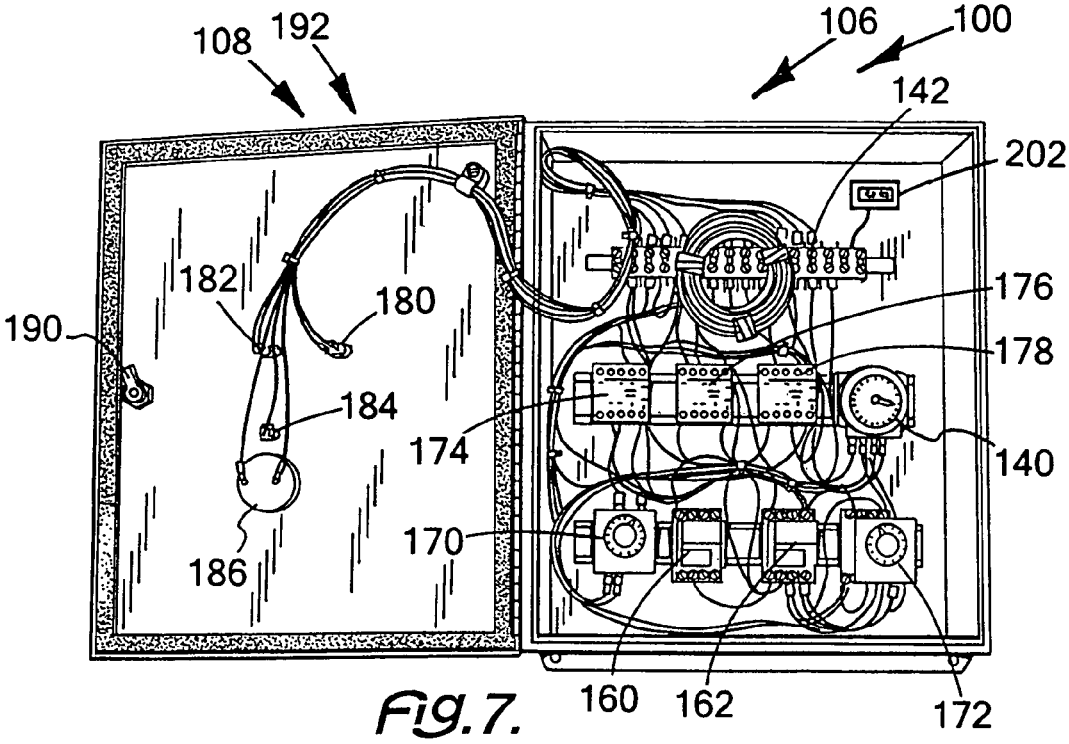
FIG. 7 depicts a front perspective view of the cabinet 106 with the door in open position 192 detailing the components of the periodic tester 100 of this invention.

Now adding FIG. 7 to the consideration, the components of cabinet 106 can be clearly seen. Cabinet 106 is depicted with door 108 in the open position 192. On the interior of cabinet 106 is the periodic time clock 140. Also, cabinet 106 had lock 190 to prevent unauthorized access to the interior components.

Terminal block 142 has wiring attaching to failure to start light 180, coil failure alarm light 182, reset button 184, and audible alarm 186. Also, first control relay 174, second control relay 176, third control relay 178 are present and interact with coil failure alarm light 182. Moreover, first alarm relay 160 and second alarm relay 162 are present and interact with audible alarm 186. Finally, time delay relay 170 and alarm time delay relay 172 time out.

Figure 8:
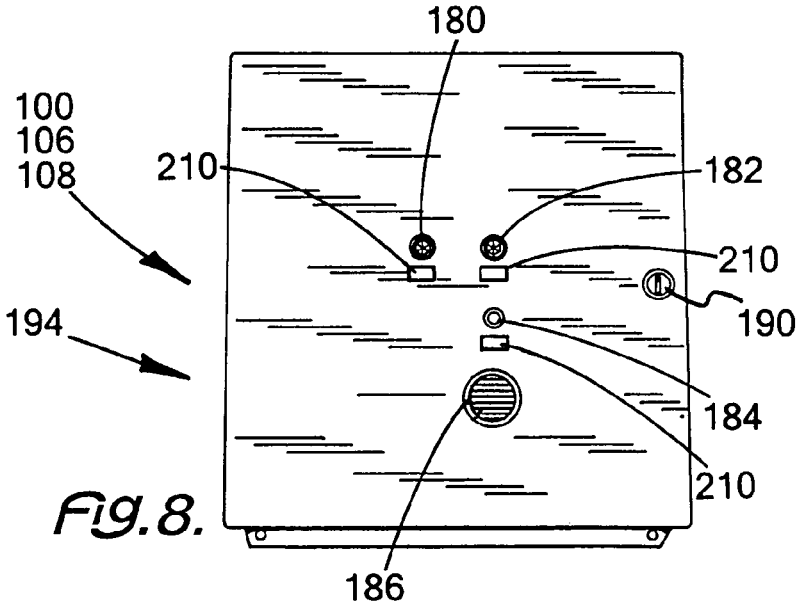
FIG. 8 depicts a front perspective view of the cabinet 106 with the door 108 in closed position 194 featuring warning lights 180 and 182, reset button 184, lock 190, and audible sound alarm 186.

Now adding FIG. 8 to the consideration, the cabinet 106 has door 108 in closed position 194. The exterior surface of door 108 has failure to start light 180, coil failure alarm light 182, reset button 184, and the audible alarm 186. These emergency warning features are on the exterior of door 108 so any passerby can view the activated light and take appropriate action. Also, door 108 has lock 190 which prevents unauthorized people from accessing the interior components of cabinet 106.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A periodic tester for monitoring an electrical fire pump system comprising:

a) the periodic tester being housed in a cabinet;

b) the periodic tester having a periodic time clock in order for the periodic tester to test at a given interval of time mounted in a cabinet housing;

c) a fire pump controller being housed in a fire pump controller housing;
d) the periodic tester and the fire pump controller being electrically interconnected;
e) an electric motor being connected to a fire pump through a coupling;
f) a sprinkler system interfacing with the fire pump controller;
g) the fire pump being connected to the sprinkler system;
h) the fire pump providing power for the sprinkler system;
i) the periodic tester interfacing with the electric motor;
j) a pilot pipe being connected to the sprinkler system;
k) the pilot pipe communicating with the fire pump controller;
l) the fire pump controller having a power on/off pressure switch;
m) the power on/off pressure switch communicating with a contactor assembly with a contactor coil and a contactor switch;
n) the pilot pipe communicating with the power on/off pressure switch;
o) the pilot pipe having at least one orifice union to minimize pressure surges to the power on/off pressure switch;
p) the periodic time clock communicating with the power on/off pressure switch, either directly or indirectly through a solenoid valve which interacts with the sprinkler system;
q) a circuitry to illuminate a failure to start light being housed in the cabinet of the periodic tester;
r) an exterior of the cabinet of the periodic tester having the failure to start light which is illuminated if the fire pump fails to start during a testing cycle;
s) a circuitry to illuminate a coil failure alarm light being housed in the cabinet of the period tester;
t) the exterior of the cabinet having the coil failure alarm light which is activated if the contactor coil is responsible for the failure of the fire pump to start;
u) a circuitry to sound an audible alarm being housed in the cabinet of the periodic tester;
v) the exterior of the cabinet having the audible alarm which sounds if the fire pump fails to start during a testing cycle; and
w) the exterior of the cabinet having a reset button which silences the audible alarm and extinguishes the failure to start light.

2. The periodic tester of claim 1 further comprising:
a) the periodic tester having a third control relay electrically connected to the periodic time clock in order to open the solenoid valve and let water in the pilot pipe to flow to waste or to activate the output of the power on/off pressure switch;
b) the power on/off pressure switch being piped to the sprinkler system in order to communicate a pressure change in the sprinkler system to the power on/off pressure switch;
c) the power on/off pressure switch being electrically connected to the contactor coil; and
d) the contactor switch being electrically connected to the electric motor in order to power the electric motor.

3. The periodic tester of claim 2 further comprising:
a) the third control relay and an alarm time delay relay with the time delay relay being electrically connected to the third control relay so that the close of the third control relay energizes the alarm time delay relay; and
b) the alarm time delay relay and a first control relay being electrically connected in order for the energized alarm time delay relay to be deenergized when the contactor switch or assembly closes.

4. The periodic tester of claim 3 further comprising:
a) the alarm time delay relay being electrically connected to the third control relay;
b) the alarm time delay relay interfacing with the open solenoid valve or interfacing with the output of the power on/off pressure switch;
c) the alarm time delay interfacing with the contactor switch such that the alarm time delay relay closes its contacts if the contactor switch fails to close;
d) the first control relay being electrically connected to a first alarm relay so that if the first control relay is not energized, it will energize the first alarm relay;
e) the first alarm relay being electrically connected to the failure to start light and the audible alarm; and
f) the energized first alarm relay cooperating to illuminate the failure to start light and sound the audible alarm.

5. The periodic tester of claim 3 further comprising:
a) the alarm time delay relay being electrically connected to the third control relay in such a way that after the solenoid valve opens or the output of the power on/off pressure switch is activated the alarm time delay relay closes its contacts if the contactor switch fails to close;
b) the first control relay being electrically connected to the first alarm relay in order for the first alarm relay to be energized if the first control relay is not energized;
c) the first alarm relay being electrically connected to the failure to start light and the audible alarm in order for the energized time delay relay to illuminate the failure to start light and sound the audible alarm; and
d) a second alarm relay being electrically connected to the coil failure alarm light in order for the energized second control relay to illuminate the coil failure alarm light.

6. The periodic tester of claim 3 further comprising:
a) the cabinet housing a counter which indicates the number of successive times the reset button is reset; and
b) the cabinet having a lock.

7. The periodic tester of claim 3 further comprising:
a) the solenoid valve being interconnected to the sprinkler system;
b) the periodic time clock having an electrical connection to the solenoid valve; and
c) the periodic time clock cooperating with the solenoid valve to open and close the solenoid valve.

8. A method of detecting the readiness of a fire pump system comprising:
a) providing a periodic fire pump tester to monitor the readiness of the fire pump system;
b) providing the periodic tester with a periodic time clock;
c) the periodic tester interacting with a fire pump controller;
d) the periodic tester interacting with an electric motor;
e) the periodic tester interacting with a sprinkler system;
f) the sprinkler system interacting with the fire pump controller;
g) a fire pump interacting with the sprinkler system;
h) having the fire pump provide power for the sprinkler system;
i) interacting the periodic tester to a solenoid valve or to the power on/off pressure switch;
j) providing the periodic time clock which is capable of being activated and deactivated;

k) activating the periodic time clock and causing the solenoid valve to open or the output of the power on/off pressure switch to be activated;

l) interconnecting the periodic tester to the electric motor;

m) connecting the sprinkler system to a pilot pipe;

n) having the pilot pipe communicate with the fire pump controller;

o) providing a jumper start to the power on/off pressure switch to cause a contactor assembly which has a contactor coil and a contactor switch to close;

p) providing the periodic tester with a failure to start light which is illuminated if the fire pump fails to start during a testing cycle;

q) providing the periodic tester with a coil failure alarm light which is activated if the contactor coil is responsible for the failure of the firs pump to start;

r) providing the periodic tester with an audible alarm which sounds if the fire pump fails to start during a testing cycle; and s) providing the periodic tester with a reset button which silences the audible alarm and extinguishes the failure to start light.

9. The method of claim 8 further comprising:

a) providing the periodic time clock being capable of being set to cycle for a set period of time;

b) providing the periodic time clock being capable of only attempting to start the fire pump controller once during a given cycle;

c) having the pilot pipe communicate with the power on/off pressure switch;

d) providing the pilot pipe with at least one orifice union to minimize the pressure surges to the power on/off pressure switch; and e) having the periodic time clock communicate either directly with the power on/off pressure switch or indirectly through the solenoid valve.

10. The method of claim 9 further comprising:

a) providing the periodic tester with a time delay relay and a third control relay;

b) having the periodic time clock energize the time delay relay and the third control relay;

c) having the energized time delay relay and third control relay either open the solenoid valve and let water in a pilot pipe to flow to a waste or to energize the output of the power on/off pressure switch;

d) providing the power on/off pressure switch being mechanically connected to the pilot pipe in order to communicate a pressure change in the sprinkler system to the power on/off pressure switch;

e) providing the power on/off pressure switch being electrically connected to the contactor coil; and f) providing the contactor switch being electrically connected to the electric motor in order to power the electric motor.

11. The method of claim 10 further comprising:

a) having a time opening contact of the time delay relay being greater than a time closing contact of an alarm time delay relay; and b) having the time delay period being greater than the normal interval of time between closure of the power on/off pressure switch contacts and the closure of the contactor switch in fire pump controller.

12. The method of claim 11 further comprising:

a) providing the third control relay and the alarm time delay relay and the time delay relay being electrically connected so that the close of the third control relay energizes the alarm time delay relay; and b) providing the alarm time delay relay and a first control relay being electrically connected in order for the energized alarm time delay relay to energize the first control relay.

13. The method of claim 12 further comprising:

a) having the first control relay which if not energized, energize the first alarm relay; and b) having the energized first alarm relay illuminating the failure to start light and sounding the audible alarm.

14. The method of claim 12 further comprising:

a) having the first control relay which if not energized, energize the first alarm relay;

b) having the energized first alarm relay illuminate the failure to start light and sound the audible alarm; and c) having a second control relay energize and illuminate the coil failure alarm light.

15. The method of claim 12 further comprising:

a) providing the periodic tester with a counter which indicates the number of successive times the reset button is reset;

b) having the periodic tester contained in a cabinet;

c) providing the cabinet with a lock;

d) having the periodic tester being located inside the cabinet; and e) retro fitting the periodic tester to the existing fire pump system.

* * * * *